US011957245B2

(12) United States Patent
Barton et al.

(10) Patent No.: US 11,957,245 B2
(45) Date of Patent: Apr. 16, 2024

(54) COUPLING PLATFORM FOR UTILITY MODULE

(71) Applicant: Milwaukee Electric Tool Corporation, Brookfield, WI (US)

(72) Inventors: George Barton, Mequon, WI (US); Aaron S. Blumenthal, Shorewood, WI (US); Honesto D. Camposagrado, Milwaukee, WI (US); Matthew A. Lownik, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 170 days.

(21) Appl. No.: 17/729,423

(22) Filed: Apr. 26, 2022

(65) Prior Publication Data

US 2022/0322828 A1 Oct. 13, 2022

Related U.S. Application Data

(63) Continuation of application No. PCT/US2022/024382, filed on Apr. 12, 2022.

(60) Provisional application No. 63/213,320, filed on Jun. 22, 2021, provisional application No. 63/174,293, filed on Apr. 13, 2021.

(51) Int. Cl.

| | |
|---|---|
| ***B65D 21/02*** | (2006.01) |
| ***A47B 95/00*** | (2006.01) |
| ***A47C 7/62*** | (2006.01) |

(52) U.S. Cl.

CPC ..... *A47B 95/00* (2013.01); *A47C 7/626* (2018.08)

(58) Field of Classification Search

CPC ..... A47B 95/00; A47B 97/00; A47B 13/16; A47C 7/626; B25H 3/02

See application file for complete search history.

(56) References Cited

U.S. PATENT DOCUMENTS

| | | | | |
|---|---|---|---|---|
| 9,725,209 | B1 * | 8/2017 | Ben-Gigi | B25H 3/021 |
| 10,583,962 | B2 | 3/2020 | Brunner et al. | |
| 11,485,542 | B2 * | 11/2022 | Brunner | B65D 21/0224 |
| 2012/0326406 | A1 * | 12/2012 | Lifshitz | B25H 3/02 206/503 |

(Continued)

FOREIGN PATENT DOCUMENTS

| | | |
|---|---|---|
| EP | 2465649 | 6/2012 |
| WO | WO2019/028041 | 2/2019 |
| WO | WO2020/202146 | 10/2020 |

OTHER PUBLICATIONS

International Search Report and Written Opinion for International Application No. PCT/US2022/024382, dated Jul. 29, 2022, 11 pages.

*Primary Examiner* — Amy J. Sterling

(74) *Attorney, Agent, or Firm* — Reinhart Boerner Van Deuren s.c.

(57) ABSTRACT

Various embodiments of the coupling platforms described herein are usable to couple storage units, such as modular storage units, to structures, such as to the undersides of benches or tables. One or more of the coupling platforms described herein facilitate the user supporting a newly-disengaged support unit. For example, one or more of the coupling platforms permit the user to place their hands on both sides of the storage unit to complete a disengagement between the coupling platform and the storage unit.

20 Claims, 10 Drawing Sheets

(56) References Cited

U.S. PATENT DOCUMENTS

| | | | | |
|---|---|---|---|---|
| 2016/0144500 | A1* | 5/2016 | Chen | B65D 21/023 206/349 |
| 2016/0374463 | A1* | 12/2016 | Wu | A47B 13/08 108/25 |
| 2017/0165828 | A1* | 6/2017 | Fleischmann | B65D 85/00 |
| 2017/0166352 | A1 | 6/2017 | Hoppe et al. | |
| 2019/0039781 | A1* | 2/2019 | Kögel | B65D 21/0212 |
| 2019/0225371 | A1 | 7/2019 | Hoppe et al. | |
| 2019/0308772 | A1 | 10/2019 | Gonitianer et al. | |
| 2020/0147781 | A1 | 5/2020 | Squiers et al. | |
| 2020/0165036 | A1* | 5/2020 | Squiers | A45F 3/14 |
| 2023/0122425 | A1* | 4/2023 | Camp | B25H 3/02 206/503 |

* cited by examiner

COUPLING PLATFORM FOR UTILITY MODULE

CROSS-REFERENCE TO RELATED PATENT APPLICATIONS

The present application is a continuation of International Application No. PCT/US2022/024382, filed Apr. 12, 2022, which claims the benefit of and priority to U.S. Provisional Application No. 63/174,293, filed on Apr. 13, 2021, and U.S. Provisional Application No. 63/213,320, filed on Jun. 22, 2021, each of which is incorporated herein by reference in its entirety.

BACKGROUND OF THE INVENTION

The present disclosure relates generally to the field of storage units. The present disclosure relates specifically to a coupling platform for a modular storage unit.

Storage units are often used to transport tools and tool accessories. Within a modular storage system, different units, devices and/or containers may provide varying functions, such as coupling platforms that couple to storage units. The coupling platforms are affixed to objects, such as undersides of tables or benches.

SUMMARY OF THE INVENTION

One embodiment of the invention relates to a coupling platform for a connectable utility module. The coupling platform include a base portion including a front face and a bottom surface, a plurality of male couplers extending from the bottom surface of the base portion, a first elongate structure pivotally coupled to the base portion, a securing element slidably coupled to the base portion, and a first projection slidably coupled to the securing element. Each of the plurality of male couplers includes a body and a first tongue extending from the body below and offset from the bottom surface. Each of the plurality of male couplers are configured to engage with a female coupler of a first container when the first container is positioned beneath the coupling platform such that a portion of a female coupler is received between the bottom surface and a first tongue of a male coupler. The first projection actuates between a secured position in which the first projection prevents sliding disengagement of the first container from the base portion, and an unsecured position in which the first container is permitted to slidingly disengage from the base portion. The first projection actuates between the secured position and the unsecured position in response to the securing element sliding upward with respect to the base portion.

Another embodiment of the invention relates to a coupling platform for a connectable utility module. The coupling platform includes an upper base portion, a lower base portion slidably coupled to the upper base portion, the lower base portion including a front face and a bottom face, a plurality of male couplers extending from the bottom surface of the lower base portion, and a securing element coupled to the lower base portion and releasably engageable with the first container. Each of the plurality of male couplers includes a body and a first tongue extending from the body below and offset from the bottom surface. Each of the plurality of male couplers are configured to engage with a female coupler of a first container when the first container is positioned beneath the coupling platform such that a portion of a female coupler is received between the bottom surface and a first tongue of a male coupler. The securing element actuates between a secured position in which the securing element prevents sliding disengagement of the first container from the lower base portion, and an unsecured position in which the first container is permitted to slidingly disengage from the lower base portion. The securing element actuates from the secured position to the unsecured position in response to the lower base portion sliding towards the upper base portion.

Another embodiment of the invention relates to a coupling platform for a connectable utility module. The coupling platform includes a lower base portion including a front face, a bottom surface and opposing side faces, a plurality of male couplers extending from the bottom surface of the lower base portion, and a latch pivotally coupled to the lower base portion. Each of the plurality of male couplers includes a body and a first tongue extending from the body below and offset from the bottom surface. Each of the plurality of male couplers are configured to engage with a female coupler of a first container when the first container is positioned beneath the coupling platform such that a portion of a female coupler is received between the bottom surface and a first tongue of a male coupler. The latch extends from a first end to an opposing second end. The latch pivots about an axis relative to the lower base portion. The latch includes a projection that protrudes downward and is received in a latch recess of the first container such that the latch prevents sliding disengagement of the first container relative to the lower base portion. The latch includes an interface portion coupled to the second end of the latch, and the latch is configured to translate downwardly-directed force on the interface portion into the projection pivoting upward and away from the latch recess thereby disengaging the projection from the first container.

Another embodiment of the invention relates to a coupling platform including an upper base portion, a lower base portion slidably coupled to the upper base portion, the lower base portion including a front face and a bottom surface, a plurality of male couplers, and a securing element. The plurality of male couplers extend from the bottom surface of the lower base portion. Each of the plurality of male couplers includes a tongue that is offset from the bottom surface and extends in a first direction away from the front face. The male couplers are engageable with female couplers of a storage unit, such as a first container, when the first container is positioned beneath the coupling platform. The securing element is coupled to the lower base portion and releasably engageable with the first container. The securing element actuates between a secured position in which the first container is prevented from sliding relative to the lower base portion, and an unsecured position in which the first container is permitted to slide relative to the lower base portion. The securing element actuates from the secured position to the unsecured position in response to the lower base portion sliding towards the upper base portion.

In a specific embodiment, the coupling platform includes a latch. The latch is positionable in a locked position in which a projection of the latch protrudes downward relative to the bottom surface and is received in a latch recess of the first container. When engaged with the latch recess, the latch prevents sliding displacement of the first container relative to the coupling platform, preventing disengagement of the male couplers from the female couplers. In a specific embodiment, the tongue of each of the plurality of male couplers is engageable below the ribs of female couplers of the first container when the first container is positioned beneath the coupling platform. In a specific embodiment, the securing element includes a pinion gear engaged with a rack gear. In a specific embodiment, the securing element includes a cam follower.

Another embodiment of the invention relates to a coupling platform including an upper base portion, a lower base portion, a plurality of male couplers, and a latch. The lower base portion is rigidly coupled to the upper base portion. The lower base portion includes a bottom surface and opposing side faces. The plurality of male couplers extend from the bottom surface of the lower base portion. Each of the plurality of male couplers includes a tongue that is offset from the bottom surface and extends in a first direction away from the front face. The male couplers are engageable with female couplers of a first container when the first container is positioned beneath the coupling platform. The latch is pivotally coupled to the lower base portion. The latch extends from a first end to an opposing second end. The latch pivots about an axis relative to the lower base portion. The latch includes a projection that protrudes downward and is received in a latch recess of the first container such that the latch prevents sliding displacement of the first container relative to the coupling platform. The latch includes an interface portion coupled to the second end of the latch opposite the first end. In response to a user moving the interface portion upward, the latch projection pivots out of the latch recess of the first container.

Another embodiment of the invention relates to a coupling platform for a connectable utility module including a base portion, a plurality of male couplers, an elongate structure, such as an arm, and a securing element. The base portion includes a front face and a bottom surface. The plurality of male couplers extend from the bottom surface of the base portion. Each of the plurality of male couplers includes a tongue that is offset from the bottom surface and extends in a first direction away from the front face. The male couplers are engageable with female couplers of a first container when the first container is positioned beneath the coupling platform. The elongate structure is pivotally coupled to the base portion. The securing element is coupled to the elongate structure, such as rigidly coupled. The securing element is releasably engageable with the first container such that the securing element actuates between a secured position in which the first container is prevented from sliding relative to the base portion, and an unsecured position in which the first container is permitted to slide relative to the base portion. The securing element actuates from the secured position to the unsecured position in response to the elongate structure pivoting with respect to the base portion.

In a specific embodiment, the coupling platform includes a first interface element and a second interface element coupled to the elongate structure on opposing sides of the base portion. In a specific embodiment, the coupling platform is configured to contemporaneously couple to a second container and a third container, and each of the second container and the third container have a width that is approximately half a width of the base portion.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
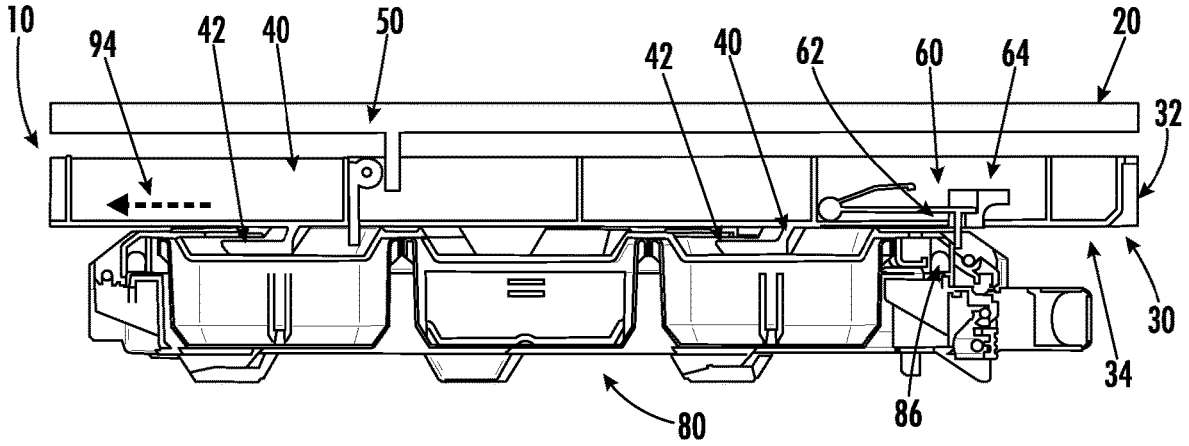
FIG. 1 is a side cross-section view of a coupling platform coupled to a storage unit, according to an exemplary embodiment.

Referring generally to the figures, various embodiments of a coupling structure, such as a coupling platform, are shown. Modular storage units are used to store and transports tools and equipment. Various embodiments of the coupling platforms described herein provide a mechanism to securely couple and decouple modular storage units to work surfaces, such as the undersides of benches or tables. According to some embodiments of modular storage units, a coupling platform is decoupled from the storage unit by disengaging a latch with one hand and sliding the storage unit with the user's other hand.

Applicant has developed various coupling platforms to facilitate the user supporting a storage unit recently decoupled from a coupling platform. According to one embodiment, the coupling platform includes a securing element that is disengaged as a result of the user placing both hands on either side of the storage unit and sliding a lower portion of the coupling platform towards an upper portion of the coupling platform. Because the user is already holding both sides of the storage unit, the user can more easily support the newly-disengaged storage unit.

Referring to FIGS. 1-8, a coupling structure, shown as coupling platform 10, is shown according to an exemplary embodiment coupled to a container, unit and/or device, shown as storage unit 80. An upper component, shown as upper base portion 20, is coupled to a work surface. For example, the work surface is a bottom of an underside of a table, a work bench, a shelf, or a cart.

A lower component, shown as lower base portion 30, is slideably coupled to upper base portion 20. The lower base portion 30 includes a bottom face 34, facing away from upper base portion 20, a front face 32, and opposing side faces 36. One or more coupling elements, shown as plurality of male couplers 40, extend from bottom face 34 of lower base portion 30. Tongue 42 of male couplers 40 is offset from bottom surface 34. Tongue 42 extends in direction 94 away from a front face 32 of lower base portion 30. In various embodiments, male couplers 40 have a similar structure to male couplers 640, which is described in more detailed below.

Figure 2:
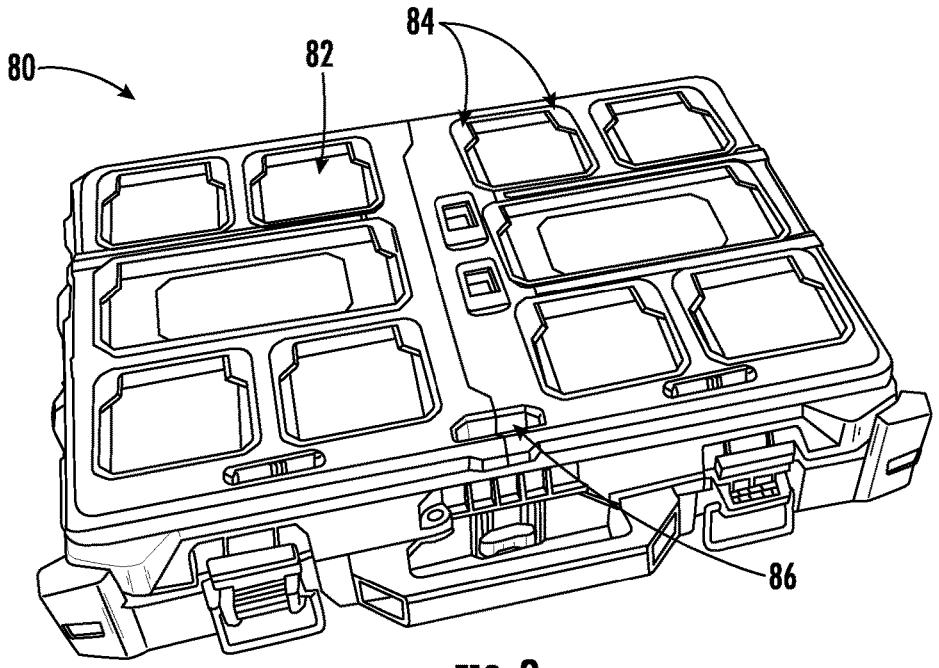
FIG. 2 is a perspective view of the storage unit of FIG. 1, according to an exemplary embodiment.

Referring to FIG. 1-2, a plurality of male couplers 40 are engageable with a plurality of female couplers 82 of storage unit 80. A coupling mechanism, shown as latch 60, is coupled to the lower base portion 30, such as slidably coupled, and releasably couples lower base portion 30 to storage unit 80. Projection 62 of latch 60 extends into latch recess 86 of storage unit 80 to maintain engagement between male couplers 40 and female couplers 82.

Storage unit 80 includes one or more recesses, shown female couplers 82. One or more projections, shown as ribs 84, extend above female couplers.

Latch 60 actuates between a locked position and an unlocked position. The latch 60 biases the storage unit 80 from slidably disengaging from the lower base portion 30 when the latch 60 is in the locked position. Stated another way, latch 60 is positionable into a locked position in which projection 62 of latch 60 protrudes downward relative to bottom surface 34 and is received in a latch recess of the storage unit such that the latch 60 prevents sliding displacement of the storage unit 80 relative to the coupling platform 10. As a result, disengagement of the male couplers 40 from the female couplers 82 when the storage unit 80 is prevented.

Figure 3:
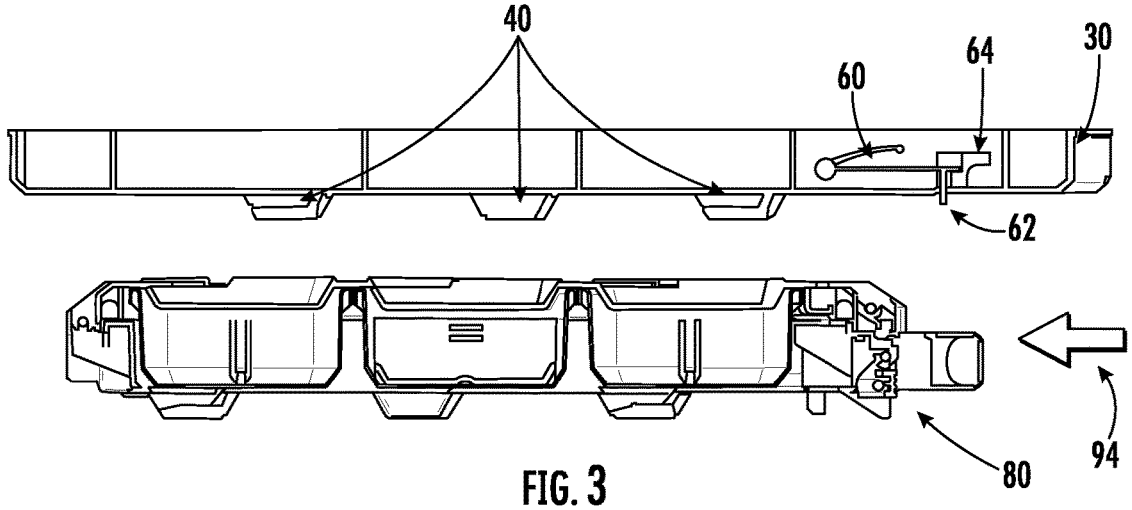
FIG. 3 is a side view of the coupling platform of FIG. 1, according to an exemplary embodiment.
Figure 4:
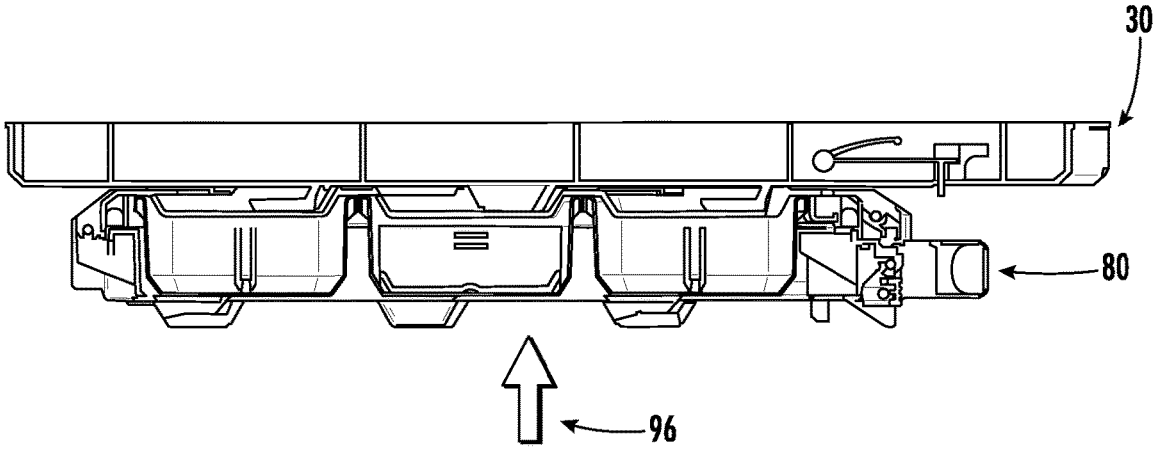
FIG. 4 is a side view of the coupling platform of FIG. 1, according to an exemplary embodiment.
Figure 5:
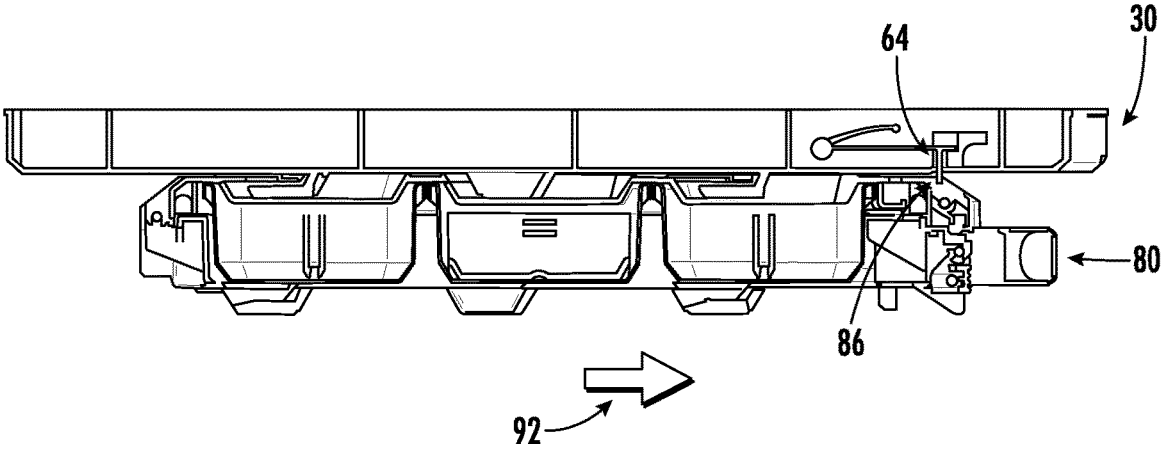
FIG. 5 is a side view of the coupling platform of FIG. 1, according to an exemplary embodiment.

Referring to FIG. 3-5, depicted is an exemplary method of coupling storage unit 80 to coupling platform 10. A user moves storage unit 80 into position below lower base portion 30 (FIG. 3), such as by moving storage unit 80 in direction 94 to position female couplers of storage unit 80 below male couplers of lower base portion 30. Storage unit 80 is moved to interface with lower base portion 30 (FIG. 4), such as by moving storage unit 80 in direction 96 relative to lower base portion 30. Then, the male couplers and the female couplers are engaged (FIG. 5), such as by moving storage unit 80 in direction 92 relative to lower base portion 30 until projection 62 of latch is received within latch recess 86 of storage unit 80.

Figure 6:
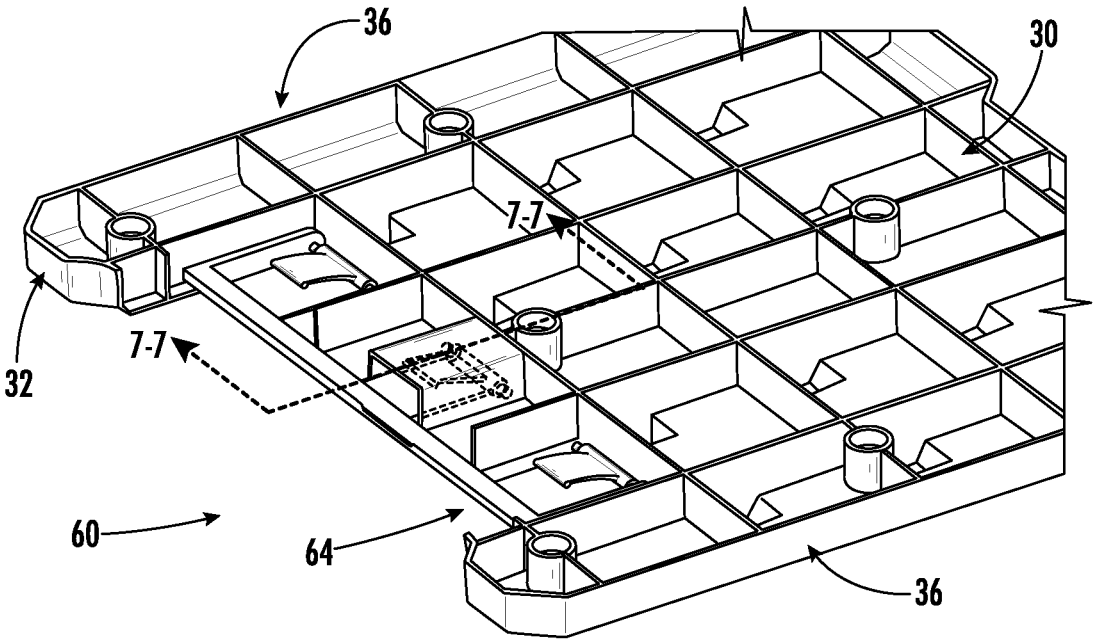
FIG. 6 is a perspective view of a portion of the coupling platform of FIG. 1, according to an exemplary embodiment.
Figure 7:
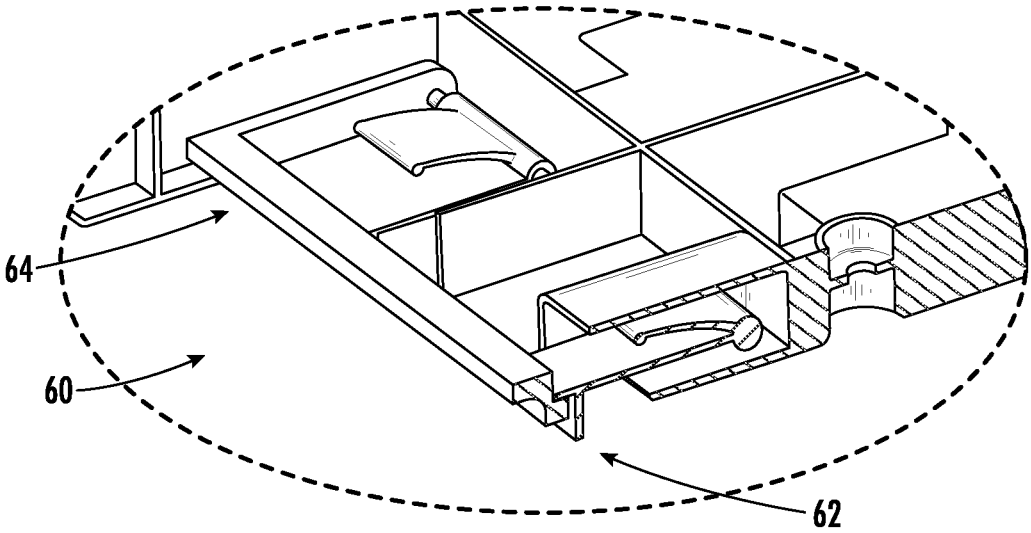
FIG. 7 is a detailed perspective view of a cross-section of a portion of the coupling platform of FIG. 1 taken along the line 7-7 in FIG. 6, according to an exemplary embodiment.

Referring to FIGS. 6-7, various aspects of latch 60 are shown. Latch 60 includes a projection 62 that interfaces with a recess, such as a latch recess in a storage unit. A user interfaces with a first interfacing portion, shown as lever 64, to actuate projection 62 into and out of the latch recess.

Figure 8:
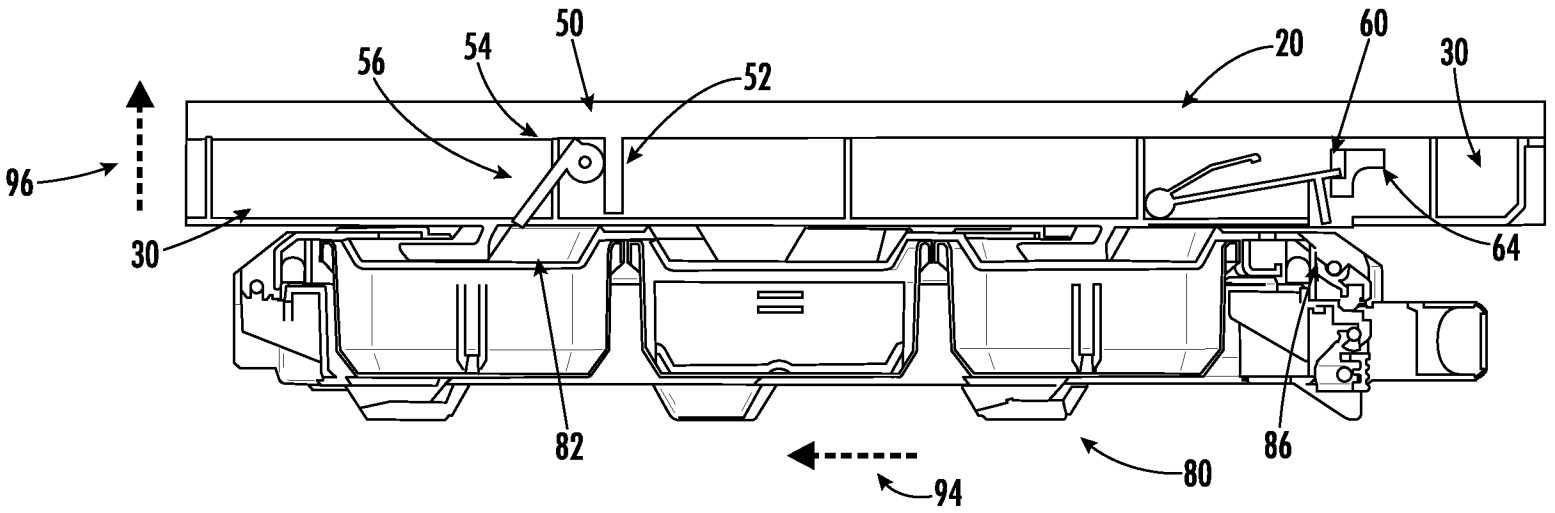
FIG. 8 is a side view of the coupling platform of FIG. 1, according to an exemplary embodiment.

Referring to FIG. 8, various aspects of decoupling storage unit 80 from coupling platform 10 are shown. To start, a user actuates latch 60, such as by pivoting lever 64 up, so that projection 62 no longer interfaces with latch recess 86 in storage unit 80.

Securing element 50 is coupled to the lower base portion, such as pivotally coupled, and is releasably engageable with the storage unit 80. To disengage storage unit 80 from lower base portion 30, a user moves storage unit 80 in direction 94 until projection 56 of securing element 50 biases storage unit 80 from sliding further relative to lower base portion 30.

Securing element 50 actuates between a secured position in which securing element 50 prevents sliding disengagement of the storage unit 80 is prevented from the lower base portion 30, and an unsecured position in which the storage unit 80 is permitted to slidingly disengage from the lower base portion 30. When securing element 50 is in the secured position, projection 56 extends within a recess in storage unit 80, such as within female coupler 82. To transition securing element 50 to the unsecured position, a user slides lower base portion 30 upward in direction 96 relative to upper base portion 20. The securing element 50 actuates from the secured position to the unsecured position in response to lower base portion 30 sliding towards the upper base portion 20, such as lower base portion 30 sliding vertically upward relative to upper base portion 20. The user then removed storage unit 80.

In a specific embodiment, securing element 50 includes a rack gear 52 and a pinion gear 54 engaged with the rack gear 52. The pinion gear 54 rotates with respect to storage unit 80 in response to lower base portion 30 sliding upward towards upper base portion 20 (FIG. 8), thereby disengaging projection 56 of securing element 50 from storage unit 80. As a result, storage unit 80 is permitted to disengage from coupling platform 10.

In a specific embodiment, the male couplers (e.g., male couplers 40, male couplers 640), the female couplers (e.g., female couplers 82), the latches (e.g., latch 60) and the latch recesses (e.g., latch recess 86) described herein are compatible with the coupling mechanism(s) described in International Patent Application No. PCT/US2018/044629, which is hereby incorporated by reference in its entirety.

Figure 9:
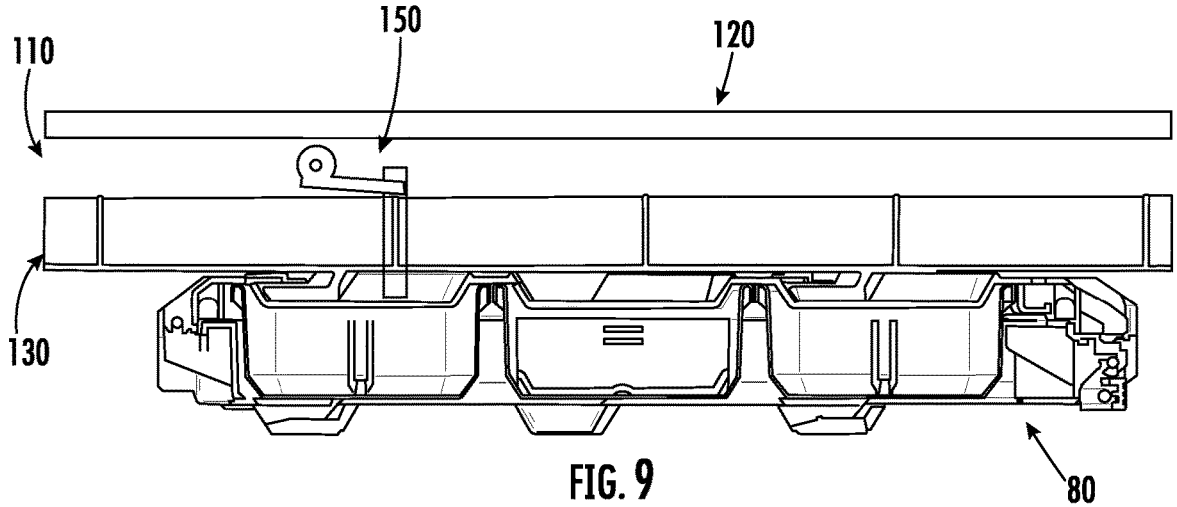
FIG. 9 is a side view of a coupling platform coupled to a storage unit, according to an exemplary embodiment.

Referring to FIG. 9, coupling platform 110 is shown according to an exemplary embodiment. Coupling platform 110 is substantially the same as coupling platform 10 except for the differences discussed herein.

Upper base portion 120 is rigidly coupled to a surface, such as an underside of a table, bench, or cart. Lower base portion 130 is slideably coupled to upper base portion 120.

Securing element 150 secures storage unit 80 from disengaging with lower base portion a30. In a specific embodiment, securing element 150 includes a cam follower.

Figure 10:
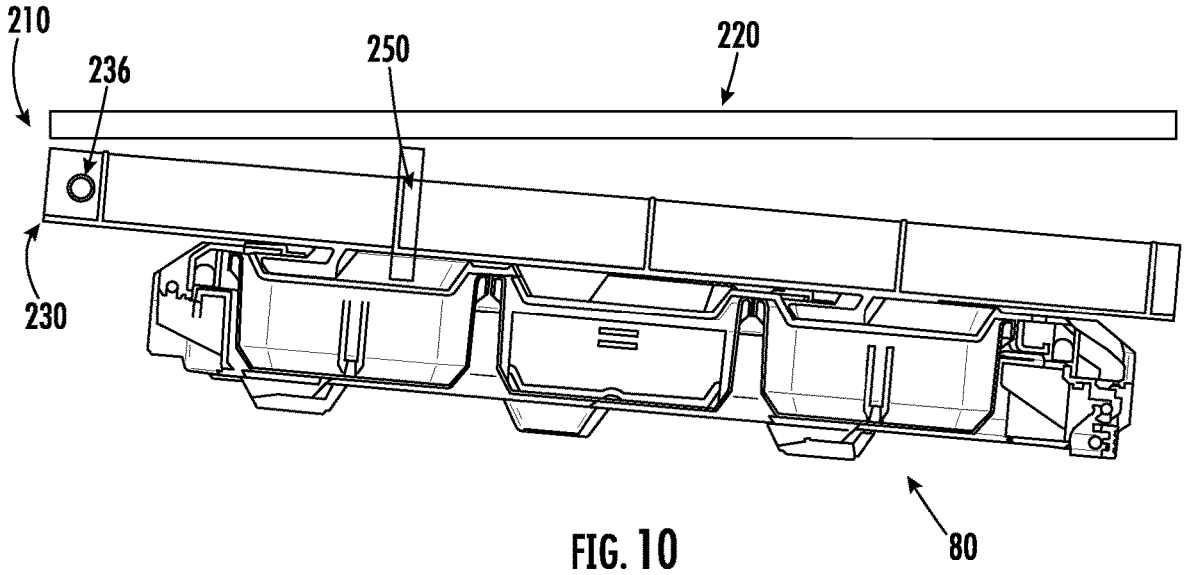
FIG. 10 is a side view of a coupling platform coupled to a storage unit, according to an exemplary embodiment.

Referring to FIG. 10, coupling platform 210 is shown according to an exemplary embodiment. Coupling platform 210 is substantially the same as coupling platform 10 or coupling platform 110 except for the differences discussed herein.

Upper base portion 220 is rigidly coupled to a surface, such as an underside of a table, bench, or cart. Lower base portion 230 is pivotally coupled to upper base portion 220. Lower base portion 230 pivots around axis 236 with respect to upper base portion 220. Securing element 250 actuates between a secured position and an unsecured position.

Figure 11:
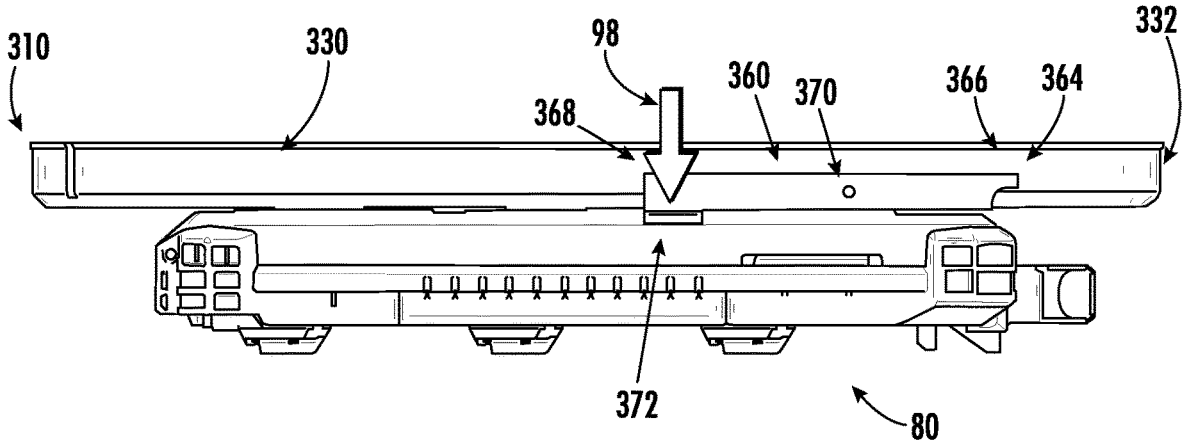
FIG. 11 is a side view of a coupling platform coupled to a storage unit, according to an exemplary embodiment.

Referring to FIG. 11, coupling platform 310 is shown according to an exemplary embodiment. Coupling platform 310 is substantially the same as coupling platform 10, coupling platform 110 or coupling platform 210 except for the differences discussed herein.

Upper base portion is rigidly coupled to a surface, such as an underside of a table, bench, or cart. Lower base portion 330 is coupled to upper base portion.

Latch 360 is coupled to the lower base portion 330, such as pivotally coupled. Latch 360 extends from a first end 366 to an opposing second end 368. Latch 360 pivots about axis 370 relative to the lower base portion 330. Latch 360 includes a projection (e.g., similar to projection 62 of latch 60) that protrudes downward and is received in a latch recess of the container such that the latch 360 prevents sliding disengagement of the container relative to the lower base portion 330. Latch includes an interface portion 372 coupled to the second end 368 of the latch 360, and the latch 360 is configured to translate downwardly-directed force on the interface portion 372 into the projection pivoting upward and away from the latch recess thereby disengaging the projection from the first container. In various embodiments, axis 370 extends parallel to the front face of the lower base portion 330, and the first end 366 is between the axis 370 and the front face 332 of the lower base portion 330.

Latch 360 includes a first lever 364 at a first end 366 of latch 360. A user interfaces with first lever 364 to actuate latch 360 out of a latch recess, such as a latch recess within storage unit 80. Latch includes an interfacing lever, shown as side-interface 372 at a second end 368 of latch 360 opposite first end 366.

In use, to disengage coupling platform 310 from storage unit 80, a user grasps both sides of storage unit 80. At one or both sides of storage unit 80, the user actuates the side-interface 372, such as via the user's thumbs, in the downward direction 98. Latch 360 pivots around axis 370 with respect to lower base portion 330, thereby disengaging latch 360 from latch recess in storage unit 80. The user can then slidably disengages storage unit 80 from coupling platform 310 while the user's hands are on both sides of storage unit 80.

Figure 12:
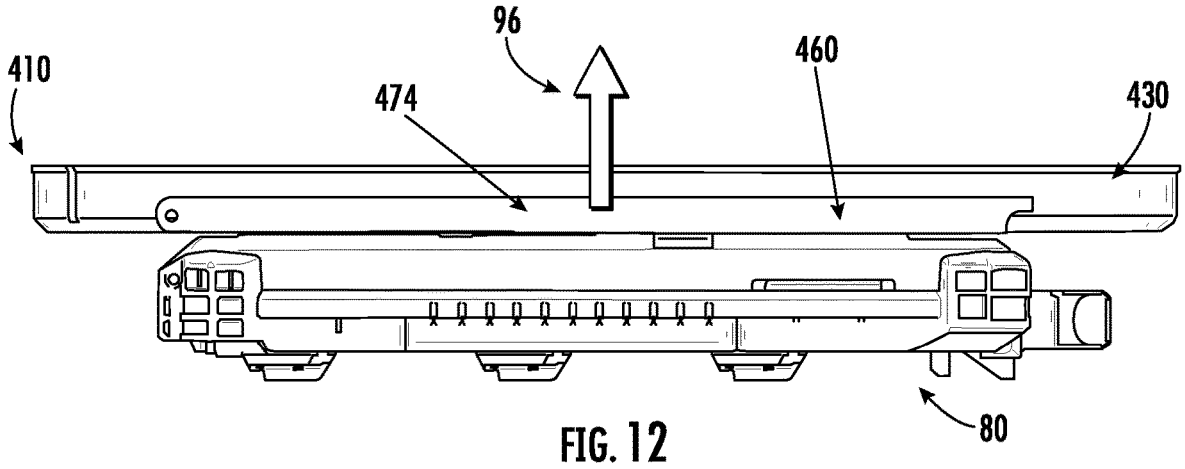
FIG. 12 is a side view of a coupling platform coupled to a storage unit, according to an exemplary embodiment.

Referring to FIG. 12, coupling platform 410 is shown according to an exemplary embodiment. Coupling platform 410 is substantially the same as coupling platform 10, coupling platform 110, coupling platform 210 or coupling platform 310 except for the differences discussed herein.

An upper base portion is rigidly coupled to a surface, such as an underside of a table, bench, or cart. Lower base portion 430 is pivotally coupled to the upper base portion.

In use, to disengage coupling platform 410 from storage unit 80, a user grasps both sides of storage unit 80. At one or both sides of storage unit 80, the user actuates the side-interface 474, such as via the user's thumbs, in the upward direction 96. Latch 460 disengages from latch recess in storage unit 80. The user can then disengage storage unit 80 from coupling platform 410 while the user's hands are on both sides of storage unit 80.

Figure 13:
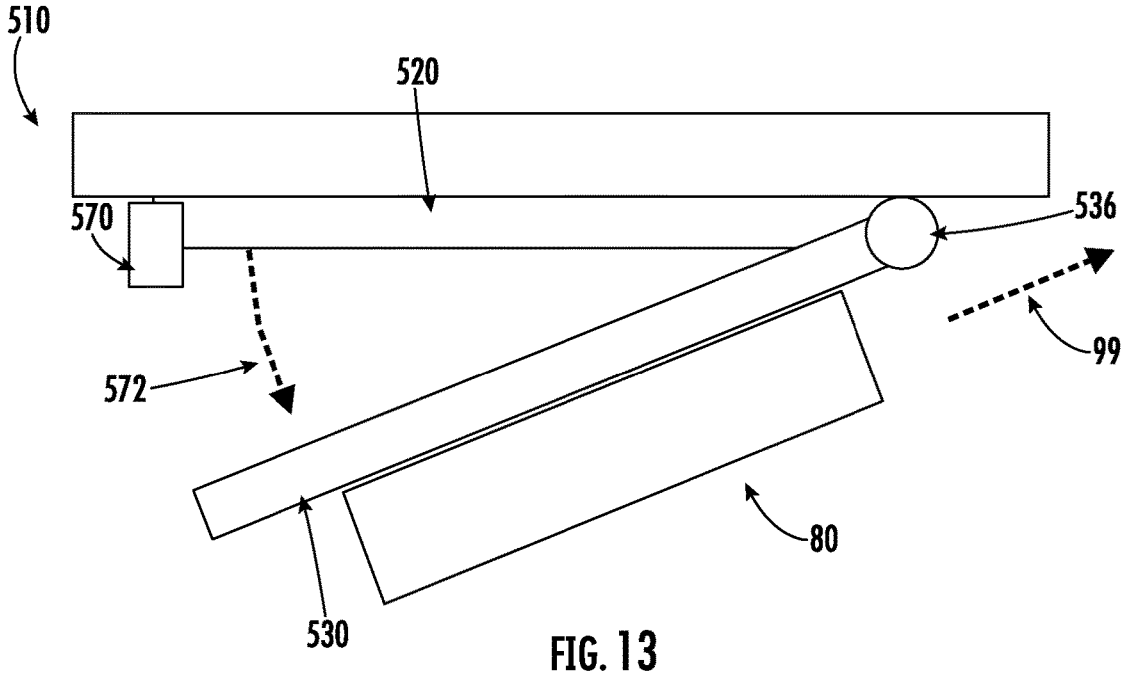
FIG. 13 is a side view of a coupling platform coupled to a storage unit, according to an exemplary embodiment.
Figure 14:
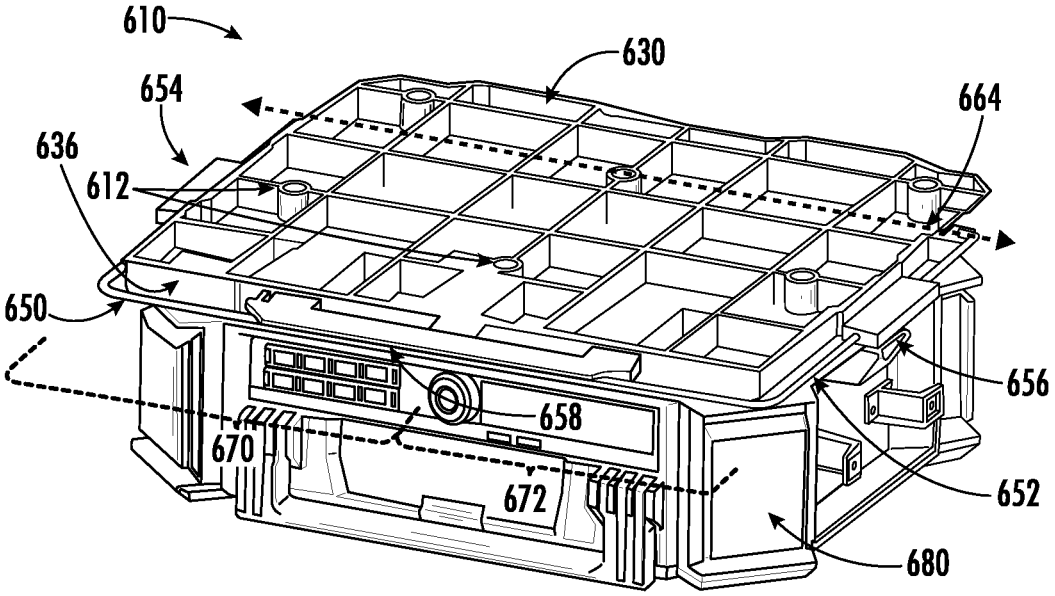
FIG. 14 is a perspective view of a coupling platform coupled to a storage unit, according to an exemplary embodiment.
Figure 15:
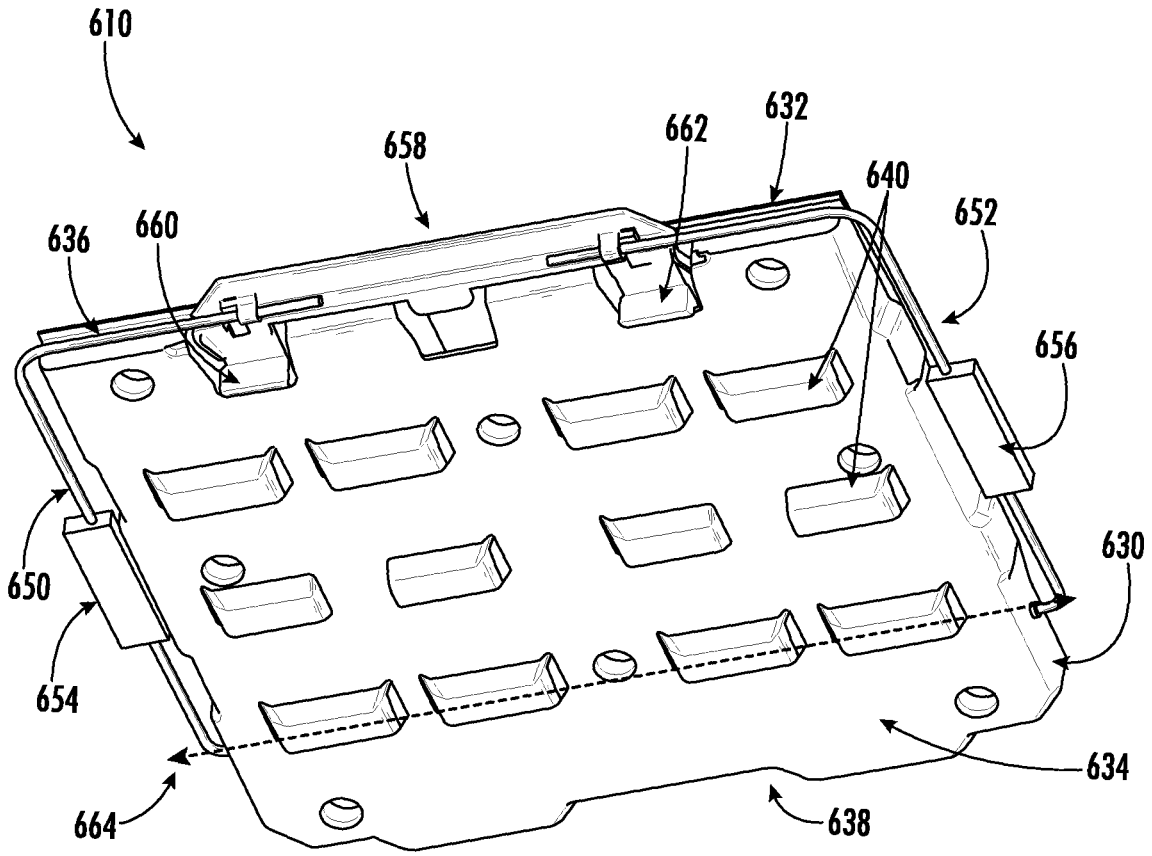
FIG. 15 is a perspective view of the coupling platform of FIG. 14, according to an exemplary embodiment.
Figure 16:
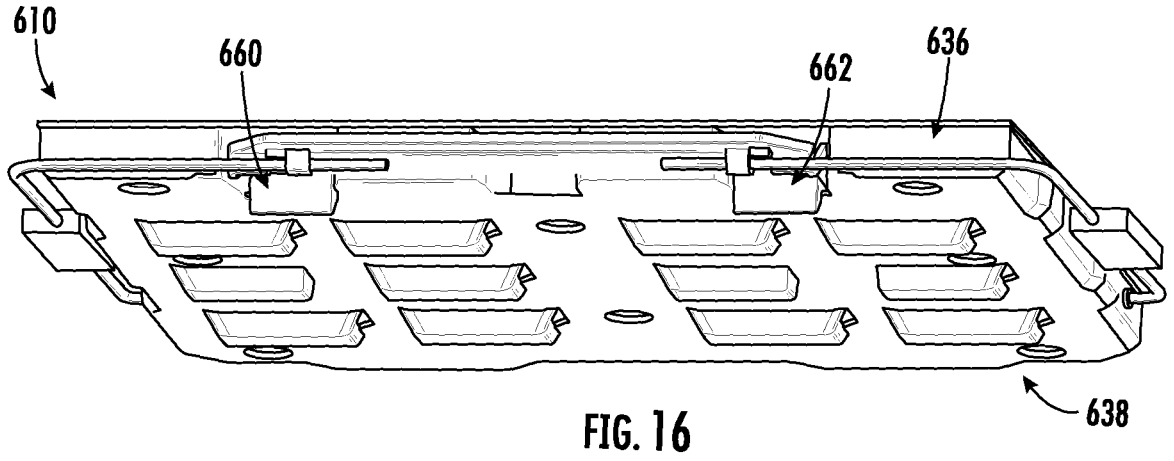
FIG. 16 is a perspective view from below and in front of the coupling platform of FIG. 14, according to an exemplary embodiment.
Figure 17:
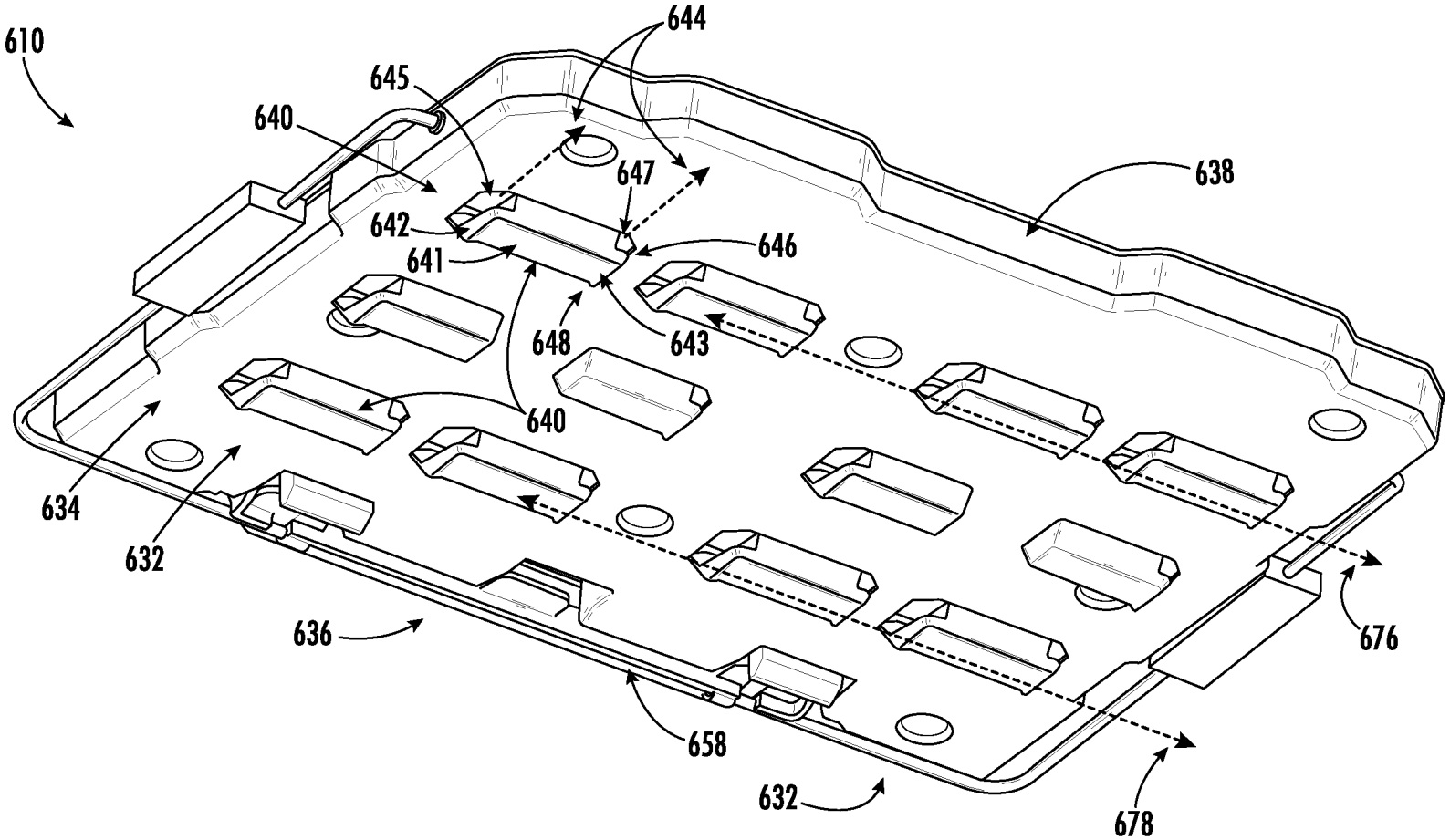
FIG. 17 is a perspective view from below and behind of the coupling platform of FIG. 14, according to an exemplary embodiment.

Referring to FIG. 13, coupling platform 510 is shown according to an exemplary embodiment. Coupling platform 510 is substantially the same as coupling platform 10, coupling platform 110, coupling platform 210, coupling platform 310 or coupling platform 410 except for the differences discussed herein.

Upper base portion 520 is rigidly coupled to a surface, such as an underside of a table, bench, or cart. Lower base portion 530 is pivotally coupled to upper base portion 520. Lower base portion 530 pivots around axis 536 with respect to upper base portion 520.

In use, lower base portion 530 is coupled against or nearly against upper base portion 520 by a securing element, shown as lock 570. A user disengages lock 570 and then rotates lower base portion 530 in direction 572 with respect to upper base portion 520. Then, the user disengages storage unit 80 from coupling platform 510 via moving storage unit 80 in direction 99.

Referring to FIGS. 14-17, coupling platform 610 is shown according to an exemplary embodiment. Coupling platform 610 is substantially the same as coupling platform 10 except for the differences discussed herein.

Coupling platform 610 includes base portion 630. Base portion 630 is coupled to a surface, such as an underside of a structure (e.g., table) via one or more coupling apertures 612, such as a plurality of apertures 612 configured to receive a fastener that couples the base portion 630 to an object. In a specific embodiment, coupling apertures 612 receive coupling elements, such as bolts and/or screws, to couple coupling platform 610 to a structure. Base portion 630 includes a front face 636 and a bottom face 634.

An elongate structure, shown as first arm 650, is coupled to one side of base portion 630, such as pivotally coupled, such that first arm 650 pivots around axis 664 with respect to base portion 630. Another elongate structure, shown as second arm 652, is coupled to an opposing side of base portion 630, such as pivotally coupled, such that second arm 652 pivots around axis 664 with respect to base portion 630. In various embodiments, first arm 650 and second arm 652 are independently pivotable with respect to base portion 630.

Securing element 658 is coupled to base portion 630, such as slidably coupled to base portion 630. Securing element 658 interfaces with first arm 650 and/or second arm 652. One or more projections 660, 662 are slidably coupled to securing element 658 and/or base portion 630 via securing element 658. The projections 660, 662 extend downward and engage with recesses in a storage container to couple the storage container to coupling platform 610, such as first projection 660 and second projection 662.

First projection 660 actuates between a secured position in which the container 680 is prevented from sliding disengagement relative to the base portion 630, and an unsecured position in which the container 680 is permitted to slide relative to the base portion 630. In various embodiments, the first projection 660 actuates between the secured position and the unsecured position in response to the securing element 658 sliding upward with respect to the base portion 630.

Second projection 662 actuates between a secured position in which the second projection 662 prevents sliding disengagement of the first container 680 from the base portion 630, and an unsecured position in which the first container 680 is permitted to slidingly disengage from the base portion 630. In various embodiments, the second projection 662 actuates between the secured position and the unsecured position in response to the securing element 658 sliding upward with respect to the base portion 630.

In various embodiments, when securing element 658 is moved upward each of first projection 660 and second projection 662 slide upward, thereby disengaging each of first projection 660 and second projection 662 from any container(s) coupled to coupling platform 610. For example, a single container, shown as container 680, may extend across the entire width of coupling platform 610 such that both first projection 660 and second projection 662 restrict container 680 from sliding with respect to base portion 630 (e.g., thereby securing container 680 to base portion 630).

In another example, two different containers are coupled to coupling platform, each of which are approximately half of the width of container 680, such that one container (e.g., the left-most container from the perspective of FIG. 14) interfaces with first projection 660 and the other container (e.g., the right-most container from the perspective of FIG. 14) interfaces with second projection 662. To disengage both containers the user actuates securing element 658, which biases both projections 660, 662 upward, thereby disengaging projections 660, 662 from the containers.

As noted above, first arm 650 and second arm 652 are independently pivotable with respect to base portion 630. To disengage only the left-most container, the user actuates first arm 650, such as by pushing first interface 654 upward, resulting in first projection 660 sliding upward with respect to both the left-most container and securing element 658. In this way, the second projection 662 still interfaces within a recess in the right-most container even while first projection 660 is slid out of the left-most container.

There is a similar process to disengage the right-most container. In particular, the user actuates second arm 652, such as by pushing second interface 656 upward, resulting in second projection 662 sliding upward with respect to both the left-most container and securing element 658. In this way, the first projection 660 still interfaces within a recess in the left-most container even while second projection 662 is slid out of the left-most container. Securing element 658 actuates from the secured position to the unsecured position in response to first arm 650 pivoting with respect to base portion 630.

To decouple full-width storage container 680 from coupling platform 610, a user actuates securing element 658 at the front of coupling platform 610. Alternatively, to decouple storage container 680 from coupling platform 610 a user actuates both interface 654 and interface 656 of coupling platform 610. In a specific embodiment, interface element 654 and interface element 656 are coupled to first arm 650 on opposing sides of the base portion 630.

In a specific embodiment, coupling platform 610 is configured to couple to a compact-sized storage container (e.g., a storage container that has a width approximately half the width of storage container 680). In use, the compact-sized storage container couples to one of the two subsets of coupling platform 610, shown as halves 670, 672.

Stated another way, to decouple a compact-sized storage container from half 670, a user moves interface 654 and/or securing element 658 to actuate first arm 650. As a result of first arm 650 actuating, projections extending from securing element 658 decouple from the compact-sized storage container, thereby freeing the compact-sized storage container to be removed from coupling platform 610. Half 672 of coupling platform 610 works in a similar manner as half 670 to couple and decouple with compact-sized storage container. In a specific embodiment, coupling platform 610 is configured to contemporaneously couple to a second container and a third container, and each of the second container and the third container have a width approximately half a width of base portion 630.

In use, to decouple a storage container from coupling platform 610 a user moves (e.g., pulls) one or more of interfaces 654, 656 and/or securing element 658 to actuate first arm 650 and second arm 652 and first projection 660 and second projection 662. As a result of projections 660, 662 actuating away from the storage container, the projections 660, 662 no longer interface with a recess in the storage container thereby permitting the storage container to be decoupled from coupling platform 610.

One or more coupling components, shown as male couplers 640, extend from bottom face 634 of base portion 630. Male couplers 640 include one or more tongues 642, 643 that extend from opposing sides of body 641. Tongues 642, 643 extend in direction 644 away from rear face 638 of base portion 630 towards front face 636 of base portion 630. Stated another way, first tongue 642 defines first channel 645 above first tongue 642 and below plane 632 of bottom face 634, and second tongue 643 defines second channel 646 above second tongue 643 and below plane 632 of bottom face 634, and one or both of first channel 645 and second channel 646 extend from a closed end 648 to an opposing open end 647 of the respective channel. Male couplers 640 are engageable with female couplers of a storage container when the storage container is positioned beneath coupling platform 610. Stated another way, first channel 645 and second channel 646 are configured to receive a portion of a male coupler extending from the container 680. In various embodiments, for each channel 645, 646 the open end is closer to the front face 636 of the base portion 630 than the closed end.

In various embodiments, each of the plurality of male couplers 640 includes a body 641 and a first tongue extending from the body 641 below and offset from the bottom surface 634 of base portion. Each of the plurality of male couplers 640 are configured to engage with a female coupler of a first container when the first container 680 is positioned beneath the coupling platform 610 such that a portion of a female coupler is received between the bottom surface (and/or a plane that is coplanar with the bottom surface, such as plane 632) and one or more tongues of the male coupler(s) 640.

In various embodiments, the plurality of male couplers 640 include a plurality of rows arranged parallel to each other, each of the rows including at least two male couplers. For example, first row 676 includes two or more male couplers 640, and second row 678, which is parallel to first row 676, includes two or more male couplers 640.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A coupling platform for a connectable utility module comprising:

a base portion comprising a front face and a bottom surface;

a plurality of male couplers extending from the bottom surface of the base portion, each of the plurality of male couplers comprising a body and a first tongue extending from the body below and offset from the bottom surface, each of the plurality of male couplers are configured to engage with a female coupler of a first container when the first container is positioned beneath the coupling platform such that a portion of a female coupler is received between the bottom surface and a first tongue of a male coupler;

a first elongate structure pivotally coupled to the base portion;

a securing element slidably coupled to the base portion; and a first projection slidably coupled to the securing element, wherein the first projection actuates between a secured position in which the first projection prevents sliding disengagement of the first container from the base portion, and an unsecured position in which the first container is permitted to slidingly disengage from the base portion, wherein the first projection actuates between the secured position and the unsecured position in response to the securing element sliding upward with respect to the base portion.

2. The coupling platform of claim 1, each of the plurality of male couplers comprising a second tongue extending from the body opposite the first tongue.

3. The coupling platform of claim 2, each of the plurality of male couplers define a first channel above the first tongue and a second channel above the second tongue, the first channel and second channel configured to receive a portion of a male coupler extending from the first container.

4. The coupling platform of claim 1, each of the plurality of male couplers define a first channel above the first tongue, the first channel comprising an open end and a closed end opposite the open end.

5. The coupling platform of claim 4, wherein for each channel the open end is closer to the front face of the base portion than the closed end.

6. The coupling platform of claim 1, each of the plurality of male couplers define a first channel above the first tongue, the first channel comprising an open end facing towards the front face of the base portion.

7. The coupling platform of claim 1, comprising a second elongate structure pivotally coupled to the base portion, and a second projection slidably coupled to the securing element, wherein the second projection actuates between a secured position in which the second projection prevents sliding disengagement of the first container from the base portion, and an unsecured position in which the first container is permitted to slidingly disengage from the base portion, wherein the second projection actuates between the secured position and the unsecured position in response to the securing element sliding upward with respect to the base portion.

8. The coupling platform of claim 7, wherein the first elongate structure and the second elongate structure are independently pivotable with respect to the base portion.

9. The coupling platform of claim 1, the base portion comprising a plurality of apertures configured to receive a fastener that couples the base portion to an object.

10. The coupling platform of claim 1, the plurality of male couplers comprising a plurality of rows arranged parallel to each other, each of the rows including at least two male couplers.

11. A coupling platform for a connectable utility module comprising:

an upper base portion;

a lower base portion slidably coupled to the upper base portion, the lower base portion comprising a front face and a bottom face;

a plurality of male couplers extending from the bottom surface of the lower base portion, each of the plurality of male couplers comprising a body and a first tongue extending from the body below and offset from the bottom surface, each of the plurality of male couplers are configured to engage with a female coupler of a first container when the first container is positioned beneath the coupling platform such that a portion of a female coupler is received between the bottom surface and a first tongue of a male coupler; and a securing element coupled to the lower base portion and releasably engageable with the first container, wherein the securing element actuates between a secured position in which the securing element prevents sliding disengagement of the first container from the lower base portion, and an unsecured position in which the first container is permitted to slidingly disengage from the lower base portion, wherein the securing element actuates from the secured position to the unsecured position in response to the lower base portion sliding towards the upper base portion.

12. The coupling platform of claim 11, wherein the securing element is pivotally coupled to the lower base portion, and wherein the securing element actuates from the secured position to the unsecured position in response to the lower base portion sliding vertically towards the upper base portion.

13. The coupling platform of claim 11, comprising a latch coupled to the lower base portion, the latch actuating between a locked position and an unlocked position, wherein the latch biases the first container from slidably disengaging from the lower base portion when the latch is in the locked position.

14. The coupling platform of claim 13, wherein the latch is pivotally coupled to the lower base portion.

15. The coupling platform of claim 11, each of the plurality of male couplers defining a first channel above the first tongue, the first channel comprising an open end facing towards the front face of the base portion.

16. The coupling platform of claim 11, each of the plurality of male couplers comprising a second tongue extending from the body opposite the first tongue, each of the plurality of male couplers define a first channel above the first tongue and a second channel above the second tongue, the first channel and second channel configured to receive a portion of a male coupler extending from the first container.

17. A coupling platform for a connectable utility module comprising:

a lower base portion comprising a front face, a bottom surface and opposing side faces;

a plurality of male couplers extending from the bottom surface of the lower base portion, each of the plurality of male couplers comprising a body and a first tongue extending from the body below and offset from the bottom surface, each of the plurality of male couplers are configured to engage with a female coupler of a first container when the first container is positioned beneath the coupling platform such that a portion of a female coupler is received between the bottom surface and a first tongue of a male coupler; and a latch pivotally coupled to the lower base portion, the latch extending from a first end to an opposing second end, the latch pivoting about an axis relative to the lower base portion, the latch including a projection that protrudes downward and is received in a latch recess of the first container such that the latch prevents sliding disengagement of the first container relative to the lower base portion, the latch including an interface portion coupled to the second end of the latch, the latch configured to translate downwardly-directed force on the interface portion into the projection pivoting upward and away from the latch recess thereby disengaging the projection from the first container.

18. The coupling platform of claim 17, the axis extending parallel to the front face, wherein the first end is between the axis and the front face of the lower base portion.

19. The coupling platform of claim 17, the base portion comprising a plurality of apertures configured to receive a fastener that couples the base portion to an object, the plurality of male couplers comprising a plurality of rows arranged parallel to each other, each of the rows including at least two male couplers.

20. The coupling platform of claim 17, each of the plurality of male couplers comprising a second tongue extending from the body opposite the first tongue, each of the plurality of male couplers define a first channel above the first tongue and a second channel above the second tongue, the first channel and second channel configured to receive a portion of a male coupler extending from the first container.

* * * * *